US005588157A

United States Patent [19]

Mayfield

[11] Patent Number: 5,588,157

[45] Date of Patent: Dec. 31, 1996

[54] TOILET VALVE SEAT ACTUATOR ASSEMBLY

[76] Inventor: Ralph L. Mayfield, 1233 W. Lydia, Wichita, Kans. 67213

[21] Appl. No.: 402,183

[22] Filed: Mar. 10, 1995

[51] Int. Cl.[6] ..... E03D 1/35

[52] U.S. Cl. ..... 4/397

[58] Field of Search ..... 4/395, 397–401, 4/405, 413, 414

[56] References Cited

U.S. PATENT DOCUMENTS

| | | | |
|---|---|---|---|
| 2,625,692 | 1/1953 | Hochberger . | |
| 2,675,563 | 4/1954 | Deatherage | 4/398 |
| 2,713,687 | 7/1955 | Bill et al. | 4/401 |
| 2,879,520 | 3/1959 | Hollingsworth | 4/398 |
| 3,025,530 | 3/1962 | Goostree | 4/397 |
| 3,038,168 | 6/1962 | McFarlane . | |
| 3,063,060 | 11/1962 | Brunetti et al. | 4/397 |
| 4,275,471 | 6/1981 | Becker . | |
| 4,433,445 | 2/1984 | Morris et al. . | |
| 4,575,881 | 3/1986 | Rozek . | |
| 4,660,232 | 4/1987 | Sorensen . | |
| 4,956,880 | 9/1990 | Bailet . | |
| 5,004,462 | 4/1991 | Mahler . | |

*Primary Examiner*—Charles E. Phillips
*Attorney, Agent, or Firm*—Shook, Hardy & Bacon L.L.P.

[57] ABSTRACT

A toilet tank valve seat actuator assembly is provided. The assembly is adapted for engagement with a trip handle mechanism and operable to lift the tank ball from a valve seat upon activation, thereby initiating a flush sequence, and to guide the tank ball back onto the valve seat upon completion of the sequence. The assembly includes support means for mounting to the walls of the tank. The assembly further includes means secured to the support means for guiding the tank ball along a substantially vertical path of movement between an engaged position, wherein the tank ball is in liquid tight contact with the valve seat, and a disengaged position wherein the tank ball is not in contact with the valve seat. The assembly also has means operably coupled to the guide means and being engaged to the trip handle mechanism and to the tank ball for moving the tank ball between the engaged and disengaged positions in response to activation by the trip handle mechanism.

11 Claims, 2 Drawing Sheets

10
12
14
18
20
21
22
24
26
28
29
30
31
32
34
36
38
40
50
52
54
56
58
62
64
68
69
70
72
73
74
76
78
80
84
86
88
90
92
94
2.
2.

58
62
64
73
74
76
82
84

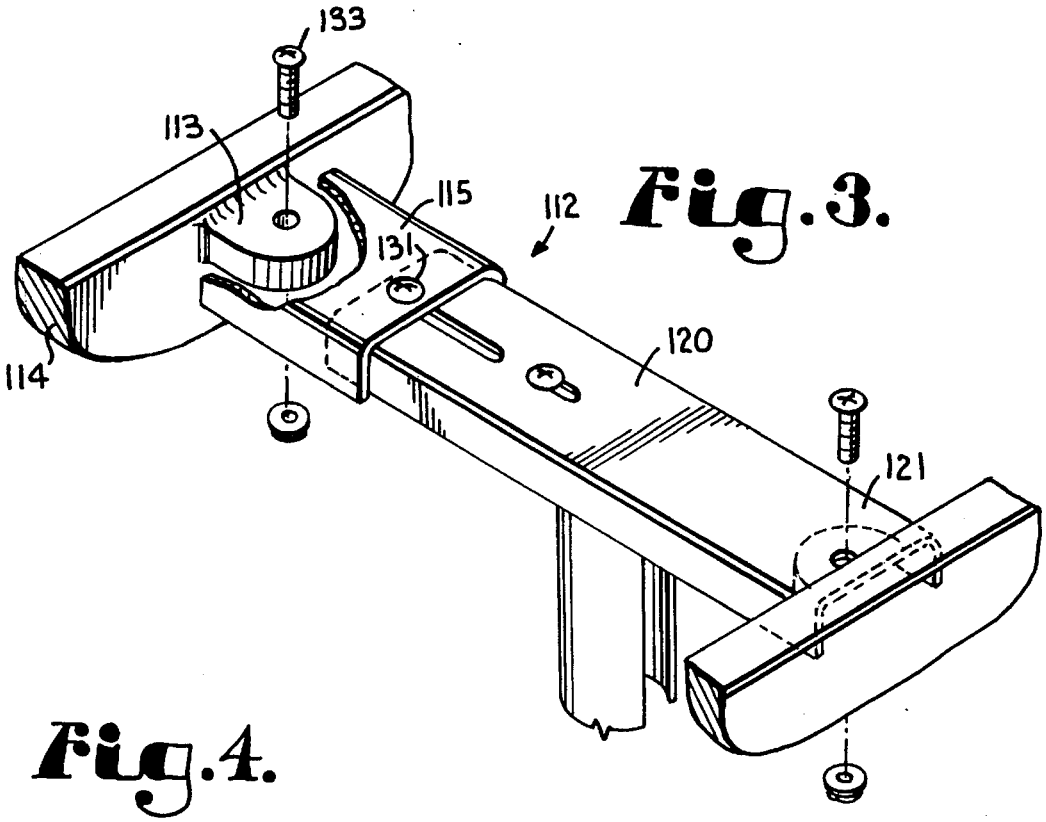
Fig. 3.
Fig. 4.
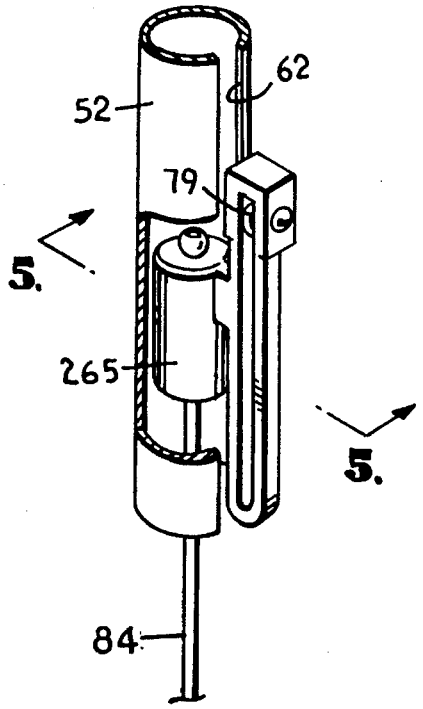
Fig. 5.
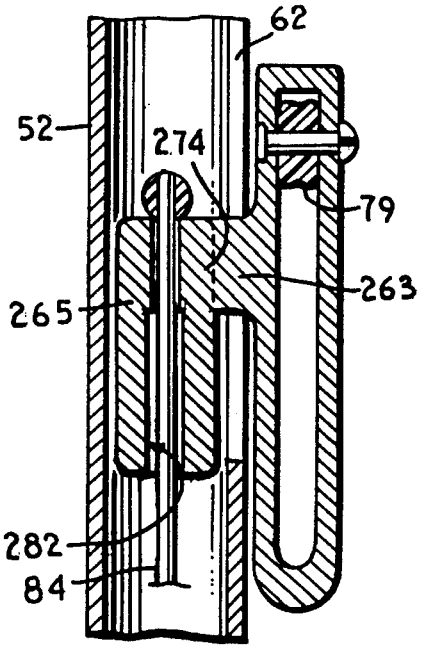

TOILET VALVE SEAT ACTUATOR ASSEMBLY

The present invention relates to toilets and, more particularly, to a toilet tank valve seat actuator assembly.

A conventional toilet includes an upper tank or water closet and a lower basin, each being filled with water. A flush sequence is initiated to dispose of water in the basin. The flush sequence empties water within the bowl and replaces it with water contained in the tank. The tank is then refilled to a predetermined level to complete the flush sequence.

The flush sequence is customarily initiated and controlled by use of a tank ball/valve seat combination located within the tank. The tank ball is held in liquid tight contact with the valve seat at the bottom of the tank by a pressure differential, thereby preventing water in the upper tank from being released. The flush sequence is initiated by an actuator assembly which lifts the tank ball from the valve seat, thereby permitting water to exit the tank by gravitational force. Once lifted from the valve seat, the buoyancy of the tank ball causes it to rise to the upper level of the water, and to subsequently descend therewith. When the water in the tank descends to a level near the bottom of the tank, the actuator assembly guides the tank ball back onto the valve seat to reform the seal therebetween. The tank is then refilled with water.

While the tank ball/valve seat combination has proven useful and is widely used, there are several problems inherent in the combination.

First, it is fundamental that the flush sequence can only be properly initiated and completed if a proper liquid tight seal between the tank ball and the valve seat is formed and maintained. This necessitates a vertical ascent of the tank ball from the valve seat and descent back to its original position. While there have been many attempts to design actuator assemblies to eliminate misalignment, incidence of malseated tank balls are prevalent in the existing actuator assemblies. Malseating causes persistent leakage of water from the tank.

Second, it is conventional that existing actuator assemblies be anchored to the overflow tube positioned centrally within the tank. This mounting strategy results in the mounting bracket being submerged a great majority of the time, which significantly increases the likelihood of corrosion. Corrosion of the mounting bracket can result in a weakened assembly or an inability to remove the assembly should repair be necessary.

Third, conventional actuator assemblies have long been constructed of metallic components. These metallic components present several problems, including the high likelihood of corrosion and hard water mineral buildup, which impede proper relative movement of the actuator assembly components.

It is, therefore, an object of the present invention to provide a toilet tank valve seat actuator assembly that reliably aligns and seats the tank ball onto the valve seat consistently with every flush sequence without incurring substantial risk of corrosion and mineral buildup on its constituent parts.

More specifically, it is an object of the present invention to provide a toilet tank valve seat actuator assembly having mounting means for securing the assembly to the walls of the tank above the upper water level so as to maintain the primary fastening element above the water within the tank for greater ease in installation and maintenance.

It is also an object of the present invention to provide a toilet tank valve seat actuator assembly having multiple alignment elements acting in concert to ensure proper alignment of the tank ball in its vertical movement from the valve seat at the initiation of the flush sequence and to reliably place the tank ball back onto the valve seat upon completion of the flush sequence to ensure a substantial liquid tight seal.

It is a further object of the present invention to provide a toilet tank valve seat actuator assembly formed mainly of corrosion-resistant materials to extend the useful life of the assembly without compromising its stability or reliability.

It is yet a further object of the present invention to provide a tank valve seat actuator assembly engineered to function efficiently and reliably for many years without concern for water leakage or corrosion-related problems.

To accomplish these and other related objects, the present invention relates to a toilet tank valve seat actuator assembly for use in connection with a toilet tank having generally upright walls. The assembly is adapted for engagement with a trip handle mechanism and operable to lift the tank ball from a valve seat upon activation, thereby initiating a flush sequence, and to guide the tank ball back onto the valve seat upon completion of the sequence. Broadly viewed, the assembly includes support means adapted for mounting to the walls of the tank. The assembly further includes means secured to the support means for guiding the tank ball along a substantially vertical path of movement between an engaged position, wherein the tank ball is in liquid tight contact with the valve seat, and a disengaged position wherein the tank ball is not in contact with the valve seat. The assembly also has means operably coupled to the guiding means and being engaged to the trip handle mechanism and to the tank ball for moving the tank ball between the engaged and disengaged positions in response to activation by the trip handle mechanism.

The accompanying drawings form part of the specification and are to be read in conjunction therewith. The drawings use numerals in the various views to indicate like parts described herein. The following views are shown:

FIG. 1 is a side perspective view of a toilet valve seat actuator assembly constructed in accordance with the present invention with parts being broken away to reveal details of construction and shown mounted to the side walls of a tank, the walls being shown fragmentally, and further illustrating the manner of engagement of the assembly to a trip handle lever, partially illustrated in phantom lines, and a tank ball, shown in phantom;

FIG. 3 is fragmentary side perspective view of an alternative embodiment of the mounting bracket in FIG. 1 having parts exploded to illustrate details of mounting and other parts being broken away to reveal details of construction;

FIG. 4 is fragmentary side perspective view of an alternative embodiment of the guide mechanism in FIG. 1 having parts broken away to illustrate the relative disposition of the constituent aligning elements; and FIG. 5 is an enlarged, fragmentary cross-sectional view of the alternative guide mechanism shown in FIG. 4 taken along line 5—5 of FIG. 4.

Figure 1:
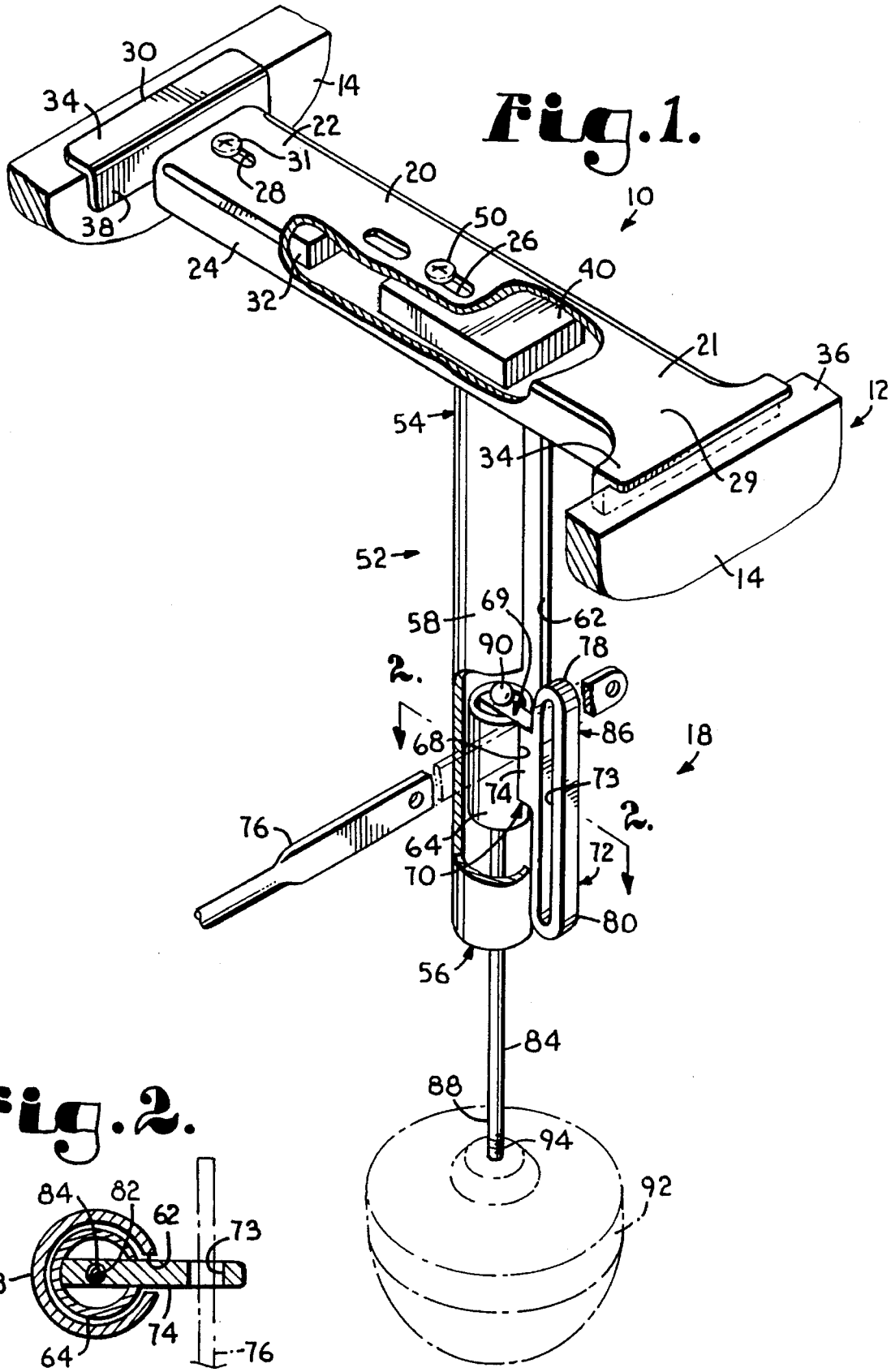
Figure 2:
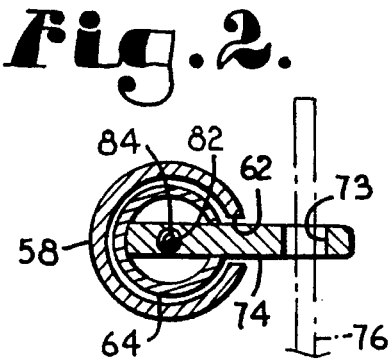
FIG. 2 is a cross-sectional view taken along line 2—2 of FIG. 1 showing the telescoping disposition of the guiding elements of the assembly and also illustrating the manner of engagement of the trip handle lever, shown fragmentally in phantom lines.

Turning now to the drawings in greater detail, and initially to FIG. 1, a toilet tank valve seat actuator assembly embodying the principles of the present invention is broadly designated by the numeral 10. Assembly 10 generally comprises a support bracket 12 for mounting the assembly 10 to the walls 14 of a toilet tank, and a guide mechanism 18 secured below the support 12 for controlling the flush sequence.

Bracket 12 includes an elongated plate 20 having a first end 21, a second end 22 and downturned side edges 24 for enhanced rigidity and support. Plate 20 also defines at least one interior groove or opening 26 located at or near the center of plate 20, and at least one end groove or opening 28 at second end 22.

Bracket 12 may be secured to walls 14 by any suitable means capable of holding bracket 12 in a stationary position above the uppermost water level in the tank. In the preferred embodiment, shown in FIG. 1, bracket 12 includes a fixed shoulder 29 mounted at first end 21 and an adjustable shoulder 30 secured to second end 22.

Fixed shoulder 29 is mounted to first end 21 by any suitable means capable of maintaining shoulder 29 in a stationary position, such as by bolting, welding, gluing and the like. In the preferred embodiment, fixed shoulder 29 is integrally formed with end 21.

Adjustable shoulder 30 is secured to second end 22 for sliding movement along the longitudinal axis of plate 20. Shoulder 30 may be secured to plate 20 by a bolt 31, or other like fastener, which extends through end groove 28 and into shoulder 30. Adjustable shoulder 30 may be moved along the axis of plate 20 to the desired position by loosening bolt 31 and physically manipulating shoulder 30. Bolt 31 may then be tightened to secure shoulder 30 in proper position.

Shoulder 30 preferably includes an integral rectangularly-shaped base structure 32 adapted to be received below second end 22 and between side edges 24. In this arrangement, edges 24 serve a dual-function: First, edges 24 act as side rails between which base 32 may be longitudinally adjusted. Second, edges 24 prohibit lateral movement of base 32 relative to plate 20. Base structure 32 is bored to receive bolt 31 from above to secure shoulder 30.

Fixed shoulder 29 and adjustable shoulder 30 each include an outwardly projecting lip 34 adapted to overlie the rim 36 of the tank and, thus, provide vertical support for assembly 10. Lips 34 should be of sufficient length to extend substantially across rim 36, but should not protrude significantly beyond rim 36 where they could interfere with proper placement of the tank lid. Lips 34 may be constructed of or covered with a substance having a sufficiently high coefficient of friction to inhibit movement of lips 34 along rim 36.

Shoulders 29 and 30 are each further equipped with an element 38 for abutting the wall 14 of the tank. Each element 38 is preferably in the form of a flat blade extending substantially vertically below the rear of its corresponding lip 34. It is understood, however, that elements 38 may be in any form presenting a surface for contacting wall 14, such as the side of a horizontally disposed cylinder. Because elements 38 are intended to contact tank wall 14, which is typically constructed of porcelain, they should present a slip-resistant surface to impede lateral movement of bracket 12 after installation. Elements 38 may also have resilient or elastic properties to provide outward force against walls 14 when installed, thereby further inhibiting movement. It is to be understood, though, that elements 38 may also function well without a slip-resistant surface or elastic mechanisms.

While bracket 12 preferably employs a fixed shoulder 29 at end 21 and an adjustable shoulder at end 22, it is anticipated that bracket 12 may utilize an adjustable shoulder 30 at both first end 21 and second end 22 and thereby replace fixed shoulder 29 with a second adjustable shoulder. Certain tank orientations may make such an embodiment more desirable than the preferred embodiment of bracket 12. This alteration of the preferred embodiment is clearly within the scope of the present invention.

Notably, because bracket 12 is adapted for mounting above the water level in the tank, it is not essential that its constituent parts be constructed of a corrosion-resistant material. Consequently, plate 20 and its constituent elements may be constructed of any rigid material such as metal, plastic, fiberglass and the like. In the interests of ease of manufacture and cost considerations, however, it is preferable that plate 20 and its elements be formed of a plastomeric material, such as nylon.

An alignment block 40 is fastened to the underside of plate 20 for securing guide mechanism 18 to bracket 12. Block 40 may be adjusted longitudinally of plate 20 for positioning the guide 18 over the valve seat at the bottom of the tank. Block 40 is generally rectangular in shape and is adapted to be received between edges 24 of plate 20. As with base structure 32, this arrangement allows edges 24 to serve as side rails between which block 40 may be longitudinally aligned. Similarly, edges 24 also perform a stabilizing function to prohibit lateral movement of block 40.

Alignment block 40 is bored to receive a bolt 50 or other like fastener extending through interior groove 26 to secure block 40 to bracket 12. To adjust block 40, and thus guide 18, bolt 50 is loosened and block 40 is moved longitudinally of plate 20 to the desired position. Once in position, bolt 50 is tightened to hold block 40 in place.

Alignment block 40 may be constructed of any rigid, corrosion resistant material, but is preferably formed of a plastomeric material, such as nylon.

Guide mechanism 18 is secured to block 40 and extends substantially vertically below it toward the valve seat. Guide 18 includes a tubular housing sleeve 52 having an upper end 54, a lower end 56 and a generally cylindrical wall 58. Wall 58 defines a longitudinal slot or canal 62 which originates at open upper mouth (not shown) and terminates at a closed bottom edge 63 above lower end 56. In the preferred embodiment, upper end 54 is affixed to block 40 by receiving a protuberance (not shown) formed below block 40 and telescoped in the upper end 54. It is understood, however, that upper end 54 may be secured to block 40 by any suitable means, such as by bolting, gluing, or threadable mounting. It is also contemplated that assembly 10 could function satisfactorily if alignment block 40 and housing sleeve 52 were formed integrally.

A tube 64 is telescoped within housing sleeve 52 for longitudinal sliding movement therein. Tube 64 is generally cylindrical in shape and defines a channel 68 generally alignable with canal 62. Channel 68 has an open upper end 69 and a closed lower end 70.

A lift arm 72 is disposed exteriorly of sleeve 52. Lift arm 72 includes an integrally formed tongue 74 extending through canal 62 of sleeve 52 and channel 68 of tube 64, being affixed to the latter. Open upper mouth of canal 62 and open upper end 69 of channel 68 are adapted to downwardly insertably receive tongue 74, thereby promoting greater ease in assembling guide mechanism 18.

Lift arm 72 defines a vertical slot 73 adapted to capture the lever 76 of a toilet trip handle mechanism (not shown). Slot 73 includes an upper end 78 and a lower end 80 and is sized to allow vertical movement of lever 76 relative to arm 72. Slot 73 is fashioned so that lever 76 contacts upper end 78 at the initiation of the flush sequence, but after initiation, lever 76 falls through slot 73 to lower end 80. This orientation allows the exterior handle to immediately resort to its original position after initiating the flush sequence without exerting substantial downward force on assembly 10, which could impede proper functioning of assembly 10. Upper end 78 may also be fitted with a roller 79, illustrated in the embodiment shown in FIG. 4, to reduce friction between the lever and the arm during initiation of the flush sequence.

While preferably integrally formed with lift arm 72, tongue 74 may also be structurally distinct and, thus, may be affixed to arm 72 by any suitable means, such as by adhesives, screws, bolts and the like. Tongue 74 is configured to present its greatest transverse dimension in the vertical plane to permit tongue 74 to slide vertically within canal 62 but not rotate therein or deviate horizontally. Tongue 74 is received into channel 68 and is fixed in position therein by any suitable means, such as by gluing. Tongue 74 preferably extends substantially across the interior of tube 64. The portion of tongue 74 lying interiorly of tube 64 defines a vertical bore 82. Bore 82 is positioned in tongue 74 so that its axis is generally concentric with the axes of sleeve 52 and tube 64.

Housing sleeve 52, tube 64, lift arm 72 and tongue 74 may be constructed of any rigid, corrosion resistant material, but are preferably formed of a plastomeric substance, such as polyvinyl chloride or nylon. It is understood, of course, that the above elements can be constructed of different materials. In addition, because the operation of assembly 10 requires the elements of guide mechanism 18 to slide against each other, the above parts should be constructed of materials with a relatively low coefficient of surface friction.

A lift rod 84 is slidably received within bore 82 and includes an upper end 86 and a lower end 88. Upper end 86 is formed to provide a stop 90 having a transverse dimension greater than the diameter of bore 82 to prevent passage therethrough. Stop 90 may comprise a weld dot, a nut or the like, or simply a bent portion of rod 84. Lower end 88 is adapted for removable attachment to a tank ball 92. In the preferred embodiment, lower end 88 includes threads 94 for complementary engagement with a conventional tank ball 92.

In an alternative embodiment, shown in FIG. 3, bracket 112 is mounted to tank by being secured to ears 113, which have been previously mounted to walls 114. Ears 113 may be integrally formed with walls 14, as in the drawing, or may be secured in fixed position by any suitable means. The mounting mechanism of alternative bracket 112 includes at least one slidable flap 115 movably secured to second end 122 and conforming to the outer surface of plate 120 for longitudinal sliding movement thereon. Flap 115 may be locked at the desired position on plate 120 by a bolt 131. Flap 115 is adapted to be mounted to its corresponding ear 113 by a bolt 133 or other like fastener. Similarly, first end 121 of plate 120 may be directly secured to its corresponding ear 115 by its respective bolt 133 or other like fastener.

In another alternative embodiment, shown in FIGS. 4 and 5, tongue 74 of guide mechanism 18 is formed in a manner to take the place of tube 64. More particularly, tongue 274 is constructed to be planar only for a neck portion 263 passing through canal 62. Once inside sleeve 52, neck 263 is enlarged to form a cylinder 265 having its axis generally concentric with the axis of sleeve 52. A stepped bore 282 is formed to extend axially of cylinder 165, as shown best in FIG. 5. Bore 182 is adapted to receive rod 84 for sliding movement within bore 182.

In use, assembly 10 is first mounted to the walls 14 of the toilet tank. Assembly 10 is positioned between walls 14 so that bracket 12 remains above the upper water level in tank. In the preferred embodiment, the bracket 12 is mounted to the rim 36 of walls 14. This disposition allows for more convenient installation and service of assembly 10 because it is not necessary to first drain tank before manipulating assembly 10. Further, this orientation allows for bracket 12 to remain substantially dry, which reduces incidence of corrosion and hard water build up on its constituent parts.

Assembly 10 is mounted to walls 14 by moving adjustable shoulder 30 longitudinally of plate 20 so that lips 34 of shoulders 29 and 30 overlie rim 36 and elements 38 firmly abut walls 14 of tank. Adjustable shoulder 30 may then be locked in place by tightening bolt 31 within end groove 28. Bracket 12 should be mounted between walls 14 it a position directly above the valve seat. Though it is certainly possible to align bracket 12 without use of supplemental equipment, a plumb or level may be employed to assist in this regard.

Once bracket 12 is properly positioned and mounted, the guide mechanism 18 may be aligned. The alignment of guide 18 is brought about by moving alignment block 40 along plate 20 until housing sleeve 52 directly overlies the valve seat. Again, this alignment procedure may be performed with or without aide of supplemental equipment. When properly aligned, block 40 is locked in place by tightening bolt 50.

Lift rod 84 is preferably attached to tank ball 92 prior to installation of assembly 10, but may be attached after assembly 10 is in position. Similarly, while it is preferable that lever 76 of trip handle mechanism be inserted into slot 73 before assembly 10 is mounted in position, lever 76 may also be engaged to slot 73 subsequent to installation.

In operation, the user initiates the flush sequence of a toilet equipped with assembly 10 by activating the trip handle mechanism. This activation causes lever 76 to rise and come into contact with upper end 78 of slot 73. The continued upward movement of lever 76 lifts arm 72 which, in turn, lifts tube 64 and lift rod 84. The upward movement of rod 84 raises tank ball 92 from the valve seat, thereby breaking the liquid tight seal therebetween. Water from within the tank escapes through the valve seat opening and into the basin of the toilet.

When the liquid tight seal between tank ball 92 and the valve seat is broken, the tank ball 92 buoys to the surface of the water within tank. The upward movement of ball 92 forces lift rod 84 upwardly through sleeve 52. Because lever 76 has returned to its original position and is now disposed at the lower end 80 of slot 73, arm 72 and tube 64 descend within sleeve 52 to their original positions with tongue 74 resting on bottom edge 63 of canal 62.

As water within the tank escapes through the valve seat opening, the water level within the tank descends. Tank ball 92 descends with the water level. The descent of tank ball 92 is guided by the concerted alignment operation of sleeve 52, tube 64, and bore 82 of tongue 74. More specifically, sleeve 52 is positioned directly above the valve seat and serves as a guide for tube 64, which slides down sleeve 52 during the flush sequence. Tube 64 functions as a descending guide for tongue 74, lowering its aligning focal point as it descends. Bore 82 within tongue 74 guides lift rod 84 along its descent with tank ball 92. Importantly, the large vertical transverse dimension of tongue 74 affords bore 82 a greater length, thereby increasing the accuracy of its alignment of rod 84.

When tank ball 92 has returned to the valve seat, a liquid tight seal is again formed. Tank ball 92 is held in contact with the valve seat by the pressure differential between water within the tank and air below ball 92. The tank then refills to its original level, thus completing the flush sequence.

It has been found that the multi-concentric guide mechanism 18 of assembly 10 reliably confines lift rod 84 for movement along a vertical path of travel above the valve seat during every flush sequence of the toilet. This ensures that tank ball 92 descends directly onto the valve seat with little or no chance of misalignment, thereby nearly completely eliminating risk of leakage or malfunction. Moreover, the corrosion-resistant elements of assembly 10 permit its prolonged repeated use without substantial risk for corrosion related problems, which could require costly repair or replacement. Thus, the efficacy and durability of the assembly 10 of the present invention represent a great technological advancement over existing actuator assemblies in the art.

From the foregoing, it can be seen that this invention is well-adapted to attain all of the objectives set forth above together with other advantages which are obvious and inherent to the invention.

It will be understood that certain features and subcombinations are useful and may be employed without reference to other features and subcombinations. This is contemplated by the invention and is within the scope of the claims.

Because many additional embodiments may be made of the invention without departing from its scope, it is to be understood that all matters set forth herein and shown in the accompanying drawings are to be interpreted as illustrative only and not in a limiting sense.

The following is claimed:

1. A toilet valve seat actuator assembly for use in connection with a toilet tank, said assembly being adapted for engagement with a trip handle mechanism and operable to lift a tank ball from a valve seat upon activation by said trip handle, thereby initiating a flush sequence, and to guide said tank ball back onto said valve seat upon completion of said sequence, said assembly comprising:

a support bracket adapted for mounting within said tank at a position generally overlying said valve seat;

a sleeve having an upper end, a lower end and a generally cylindrical wall, said sleeve being mounted to said support bracket at said upper end and disposed to extend substantially vertically downwardly over said valve seat, said sleeve defining a longitudinal canal in said wall, said canal terminating above said lower end;

a tube telescoped within said sleeve and adapted for movement along the axis of said sleeve, said tube defining a lateral hole generally alignable with said canal;

an arm defining a vertical slot adapted to engage said trip handle mechanism exteriorly of said sleeve and having a tongue securing said arm to said tube, said tongue having its greatest dimension in the vertical plane for slidable movement within said canal, said tongue also being fixably received through said hole in said tube and extending substantially across the same;

a bore defined in said tongue, the axis of said bore being generally concentric with the axis of said tube; and a lift rod having an upper end and a lower end slidably received within said bore, said upper end including a stop having a horizontal dimension greater that the diameter of said bore, thereby prohibiting movement of said stop therethrough, and said lower end including means for attachment to said tank ball.

2. The assembly of claim 1 wherein said tank includes generally upright walls defining an upper rim.

3. The assembly of claim 2 wherein said support bracket includes an elongated plate having a longitudinal axis and including opposed ends, said ends being adapted to be mounted to said walls of said tank.

4. The assembly of claim 3 wherein at least one said end includes an adjustable shoulder capable of movement along the longitudinal axis of said plate and being adapted for mounting to said rim.

5. The assembly of claim 4 wherein said slot defined by said guide arm includes an upper end and a lower end, said upper end including an interior roller adapted to engage said trip handle, thereby reducing frictional resistance therebetween.

6. A toilet valve seat actuator assembly for use in connection with a toilet tank having generally upright walls, said assembly being adapted for engagement with a trip handle mechanism and operable to lift a tank ball from a valve seat upon activation by said trip handle, thereby initiating a flush sequence, and to guide said tank ball back onto said valve seat upon completion of said sequence said assembly comprising:

a support means including a bracket for mounting to said walls of said tank, said bracket mounted between said walls of said tank at a position generally overlying said valve seat:

means secured to said support means for guiding said tank ball along a substantially vertical path of movement from an engaged position, wherein said tank ball is in liquid-tight contact with said valve seat, and a disengaged position, wherein said tank ball is not in contact with said valve seat and wherein said guiding means includes a sleeve having an upper end, a lower end and a generally cylindrical wall, said sleeve being secured at said upper end to said bracket and extending substantially vertically downwardly toward said valve seat, wherein said sleeve defines a longitudinal canal in said wall, said canal terminating above said lower end; and means operably coupled to said guiding means and being engaged to said trip handle mechanism and to said tank ball for moving said tank ball between said engaged position and said disengaged position in response to activation by said trip handle mechanism, wherein said moving means includes a sliding member operably coupled to said trip handle mechanism exteriorly of said sleeve and slidably supporting a lift rod within said sleeve, said rod being fastened to said tank ball, and wherein said sliding member includes a tube telescoped within said sleeve and defining a lateral hole generally alignable with said canal.

7. The assembly of claim 6 wherein said sliding member further includes a guide arm defining a vertical slot adapted to engage said trip handle mechanism exteriorly of said sleeve.

8. The assembly of claim 7 wherein said sliding member further includes a tongue securing said guide arm to said tube, said tongue having its greatest dimension in the vertical plane for sliding movement within said canal and being adapted to be fixably received through said hole and substantially across said tube.

9. The assembly of claim 8 wherein said tongue defines a bore having an axis generally aligned with the axis of said tube and being adapted to slidably receive said lift rod.

10. The assembly of claim 9 wherein said lift rod includes an upper end and a lower end, said upper end including a stop having a horizontal dimension greater than the diameter of said bore, said lower end including means for attachment to said tank ball.

11. The assembly of claim 10 wherein said slot defined by said guide arm includes an upper end and a lower end, said upper end including an interior roller adapted to engage said trip handle, thereby reducing frictional resistance therebetween.

* * * * *